US007503600B2

(12) United States Patent
Hautala et al.

(10) Patent No.: US 7,503,600 B2
(45) Date of Patent: Mar. 17, 2009

(54) LOCKING ARRANGEMENT

(75) Inventors: Pekka Hautala, Espoo (FI); Petri Makkonen, Helsinki (FI); Juha Murtola, Joensuu (FI); Mika Helisten, Ylämylly (FI); Kimmo Siitari, Joensuu (FI)

(73) Assignee: Abloy Oy, Joensuu (FI)

( * ) Notice: Subject to any disclaimer, the term of this patent is extended or adjusted under 35 U.S.C. 154(b) by 84 days.

(21) Appl. No.: 10/575,610

(22) PCT Filed: Sep. 23, 2004

(86) PCT No.: PCT/FI2004/000558

§ 371 (c)(1),
(2), (4) Date: Jun. 14, 2006

(87) PCT Pub. No.: WO2005/038174

PCT Pub. Date: Apr. 28, 2005

(65) Prior Publication Data

US 2007/0052251 A1 Mar. 8, 2007

(30) Foreign Application Priority Data

Oct. 14, 2003 (FI) ..... 20031495

(51) Int. Cl.
*E05B 15/02* (2006.01)

(52) U.S. Cl. ..... 292/341.17; 292/341.15

(58) Field of Classification Search ..... 70/142; 292/80, 87, 128, 303, 341.16, 341.17, DIG. 16, 292/DIG. 41, 341.18
See application file for complete search history.

(56) References Cited

U.S. PATENT DOCUMENTS

| | | | | |
|---|---|---|---|---|
| 1,959,361 | A | 5/1934 | Holtzman | |
| 3,050,322 | A * | 8/1962 | Miller | 292/114 |
| 3,247,924 | A * | 4/1966 | Price | 180/289 |
| 5,118,150 | A * | 6/1992 | Jarrett | 292/341.16 |
| 5,865,483 | A * | 2/1999 | Dubravin | 292/251.5 |

FOREIGN PATENT DOCUMENTS

| | | |
|---|---|---|
| BE | 341361 | 4/1927 |
| EP | 0611859 | 8/1994 |
| FR | 2709779 | 3/1995 |
| WO | 0114672 | 3/2001 |

* cited by examiner

*Primary Examiner*—Gary Estremsky
(74) *Attorney, Agent, or Firm*—Smith-Hill & Bedell, P.C.

(57) ABSTRACT

The present invention relates to a locking arrangement by means of which two parts can be locked to each other, such as locking a door to its frame construction. The locking arrangement comprises a first locking element fastened to the lock unit, a second locking element fastened to the counter part and an acting element being preferably a part of the lock unit. The first and second locking elements are gripping brackets, forming a hooked grip with each other when the lock unit and the counter part are against each other, when, for example, the door is locked in its opening. The gripping brackets are essentially in the direction of the movement of the door. The task of the acting element is to keep the gripping brackets in an overlapping position when the locking arrangement is locked. The position of the acting can be changed, and the current state of the locking arrangement depends on the position.

44 Claims, 10 Drawing Sheets

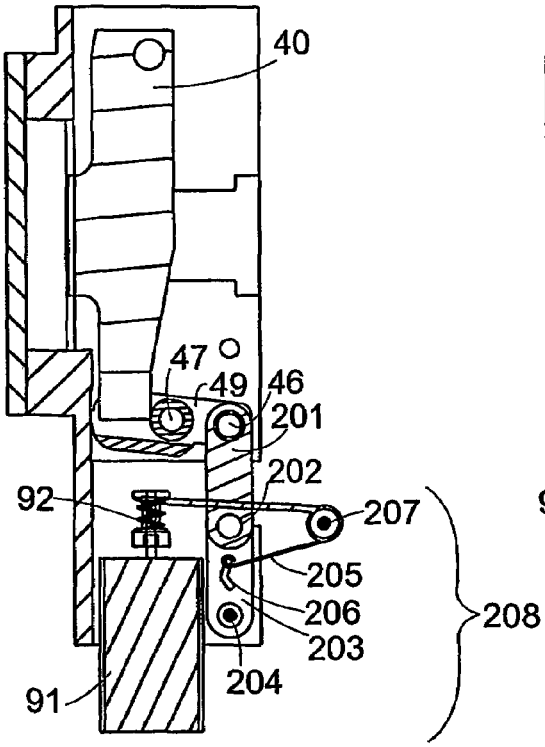
FIG. 20
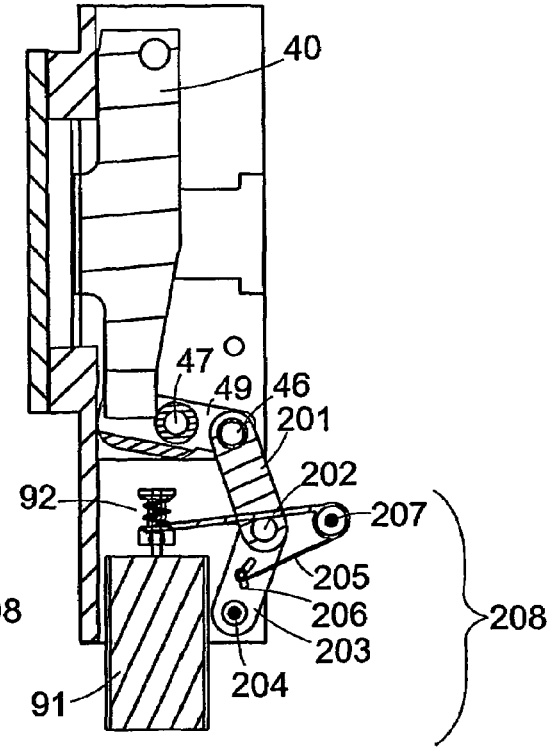
FIG. 21
FIG. 22
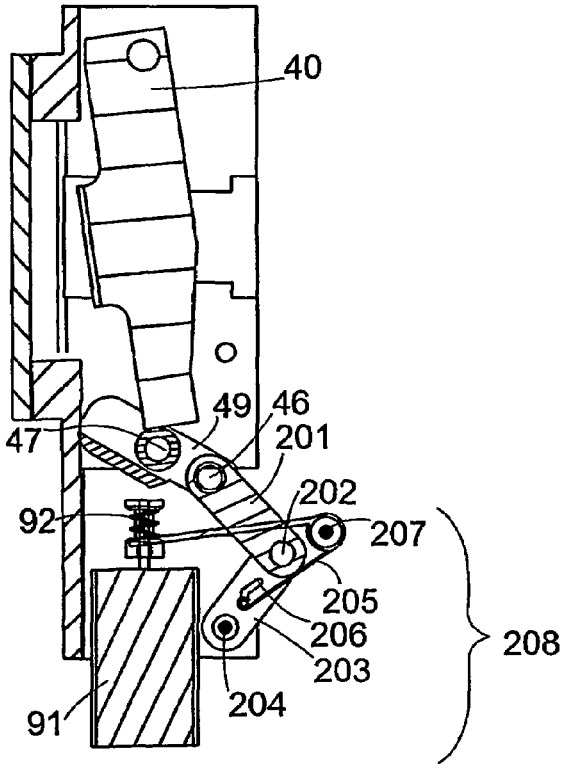

LOCKING ARRANGEMENT

FIELD OF THE INVENTION

The present invention relates to a locking arrangement for locking two parts to each other, such as locking a door or a hatch to the frame construction of a door or hatch opening.

BACKGROUND OF THE TECHNOLOGY

Figure 1:
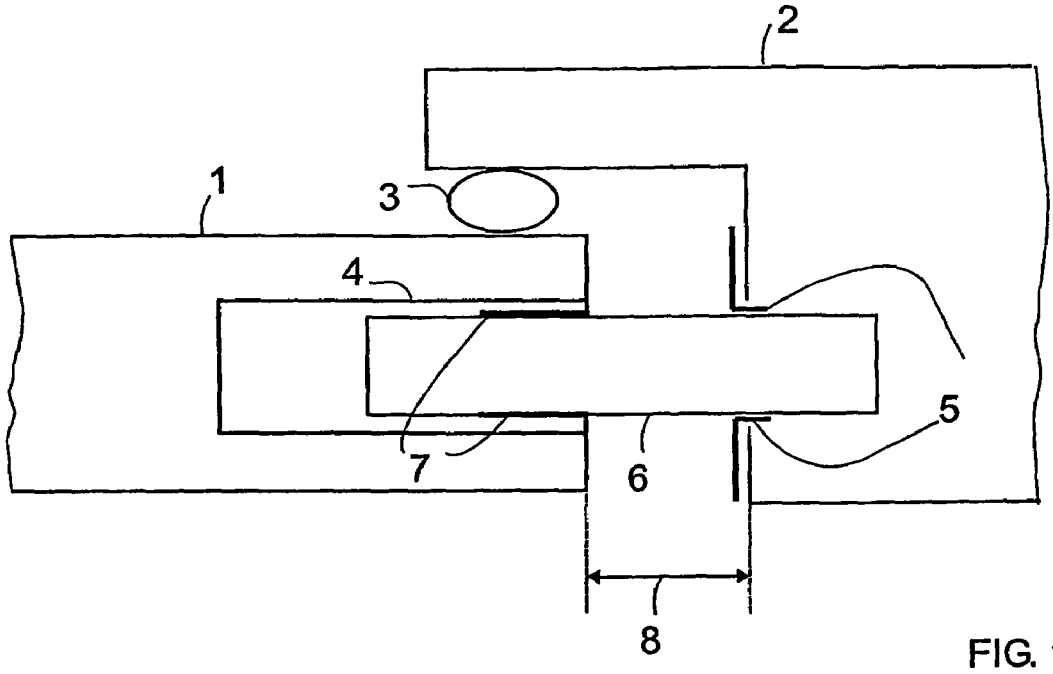

FIG. 1 illustrates a normal locking arrangement comprising a lock unit 4 and counter part 5. Usually, the lock unit is installed in a door 1 and the counter part 5 is installed in the door frame 2, but other ways of installing are also possible. Latch 6 is moved (pushed or turned) from the lock unit to the counter part, i.e. the striker plate. In the example of FIG. 1 the striker plate is installed in the door frame, and it can be seen that upon locking the door the latch is pushed into a hole in the door frame and the striker plate.

The necessary movement of the latch must be sufficient to keep the door closed in, for example, cases of vandalism, despite the door clearance, i.e. the gap 8 between the door and the frame, the clearance fluctuating on the basis of the door type, the installation tolerances, temperature etc. Typically, the door clearance is between 1 and 5 mm. Usually, the movement of the latch is 14 mm, or in a door of a higher security rating, even 20 mm. The latch is moved by, for example, a key, an electric motor or a button.

Usually, the movement of the latch is transverse to the movement of the door (direction of opening and closing), so that the force exerted on the door upon opening, such as a sealing force caused by the seal 3 or pushing the door, will make the movement of the latch considerably more difficult, because there is friction between it and, for example, the striker plate. There is friction in the inner components of the lock as well, between 7 the latch and other components of the lock unit. This means also that when opening the lock by means of a key or an electric motor, plenty of force is needed to overcome the forces and friction, if any.

Additionally, during burglary, considerable bending stress is exerted on the latch, so that the components will have to be massively dimensioned.

Because of the great force needed to move the latch and the relatively large movement of the latch, the energy needed is usually too large for battery operation. Additionally, powerful and expensive motor gearings are needed. As far as energy consumption is needed, panic exit regulations (standard EN 1125) must be considered, according to which a locked door must be capable of being opened, even though a transverse force of 1000 Newton is exerted in the central part of the door. Fulfilling this requirement using currently known solutions is very difficult and expensive.

Further, a number of sensors has previously been used for sensing the state of the object to be locked, such as a door. Separate sensors have been used for indicating, for example, whether the door is open, the locking locked and the locking open. The aim of the present invention is to reduce the above-mentioned problems of the prior art. The aim is achieved as disclosed in the claims.

BRIEF DESCRIPTION OF THE INVENTION

The system according to the invention has a new mechanism, by means of which the known locking, based on latch, can be replaced. Instead of a latch, the invention uses a first locking element, attached to the lock unit, a second locking element, attached to the counter part, i.e. to the striker plate at its simplest, and an acting element, being preferably a part of the lock unit.

The first and second locking elements are gripping brackets, forming a hooked grip with each other when the lock unit and the counter part are in their installation position against each other, for example, when the door is closed in its opening. Thus, the locking elements can be described as two catches, gripping each other when they are in a position overlapping each other (in contact with each other, that the parts stay essentially in contact with each other regardless of a certain external force or with the external force even facilitating maintaining the contact). In the installation position (such as with the units being fastened to the door and the frame) the gripping brackets are mainly transversely in relation to the swing axis of the part to be turned (such as a door), i.e. the gripping brackets are essentially in the direction of the path of movement when the part to be turned is against the counter part thereof—such as when the door is shut in the door opening. The hookedness of the gripping brackets depends on their design. Using a suitable design, the hookedness can be very small, such as only shallow curves in the brackets.

The task of the acting element is to keep the gripping brackets in an overlapping position when the locking arrangement according to the invention is locked. The position of the acting element can be changed, and the current state of the locking arrangement depends on the position. There is a gap between the acting element and the first locking element, the width of which depends on the said position. The second gripping bracket is in this gap when the brackets are overlapping each other.

When the gap is at its narrowest, there is just room for the second gripping bracket. Thus, the acting element and/or the first gripping bracket can press the second gripping bracket or a small gap will remain on both sides of the second gripping bracket. The gripping brackets and the acting element are formed so that when the gap is at its narrowest (the acting element is then in the front position) and the acting element is locked, the second gripping bracket can not be pulled away from between the acting element and the first gripping bracket, but the brackets stay in an overlapping position. When the gripping brackets are fastened to the lock unit and the counter part from their one end, and these are respectively fastened to, for example, the door and the door frame, the desired locking is accomplished.

If the acting element is not locked and the gap is at its narrowest, the second gripping bracket can be drawn away from between the acting element and the first gripping bracket, whereby the second gripping bracket simultaneously presses the acting element from the front position to the withdrawn position, whereby the gap is at its widest. In practice, in a real installation situation drawing the gripping bracket away from the gap means opening the door. In this case it is preferable to keep the acting element in withdrawn position, i.e. the gap is wide, because when an open door is being closed, it is easier for the second gripping element to enter the gap, i.e. overlap with the first gripping bracket. Simultaneously with the second gripping bracket entering the gap, it can release the acting element from the withdrawn position, whereby it is allowed to move to the front position.

Essentially and preferably the acting element is a vertical arm, hinged by its first end (in the examples of this text the upper end) to the body of the lock unit. The hinge forms a support, around which the arm can turn. In the front position the arm is in its nearest position to the first locking element, whereby the above-mentioned gap is at its narrowest. In the withdrawn position the arm is farther away in relation to the first locking element, whereby the above-mentioned gap is at its widest. The surface of the arm facing the first locking element includes a gripping tongue, the shape of which follows that of the locking element.

The arm can also include a groove, with a holding spring located therein for keeping the arm in the above-mentioned withdrawn position. When a pressing force is exerted on the release bracket of the holding spring, the holding spring moves away from the groove, whereby the arm can move to the front position.

The acting element can be locked in its front position by means of a safety catch that presses the rear edge of the arm of the acting element. The safety catch comprises a reel, the centre of which is on the side of the rear edge of the arm of the acting element, while the circumference of the roll presses the rear edge of the arm when the safety catch is on. When the safety catch is off, the central part of the reel is outside the rear edge of the arm, whereby the reel allows the arm to be moved into its withdrawn position by an external force.

The reel is fastened to the arm of the catch (preferably by its central part). The arm is fastened (e.g. hinged) by one end, the fastening end, to the body of the lock unit. The other end of the arm is hinged to the drive construction. The drive construction transmits the power to move the safety catch (the reel) on and off from, for example, an electric motor or a mechanical power apparatus, such as a key or a lock handle.

If the safety catch is not on, it will allow the acting element to move to the withdrawn position when a pressing force is exerted on the acting element (in practice the pressing of the gripping bracket against the acting element), In closer detail, the mechanics of the safety catch and the drive construction moves because of the acting force, allowing the arm of the acting element to move to the withdrawn position. When the arm is returned from the withdrawn position to the front position, the mechanics of the safety catch and the drive construction returns back to its starting state, i.e. to the state, in which the mechanics were before the force pressing the acting element moved it to the withdrawn position.

Thus, the invention relates to a locking arrangement, comprising a first locking element comprising a first free end that in installation position is mainly transversely in relation to the swing axis of the part to be turned, and a second locking element, belonging to the counter part and comprising a second free end being in the installation position mainly transversely in relation to the swing axis of the part to be turned. The locking elements are arranged to work together so that when the said units are against each other in the installation position while the door, hatch or the like is in closed position, they are overlapping each other. Additionally, the arrangement comprises an acting element, being controllably supported for achieving locking and which for achieving locking is arranged to act transversely in relation to the said locking means so that in the said position the overlapping locking elements together with the acting element prevent the lock unit and the counter part from moving away from the said contacting position by causing the said units to grip each other.

LIST OF FIGURES

Figure 2:
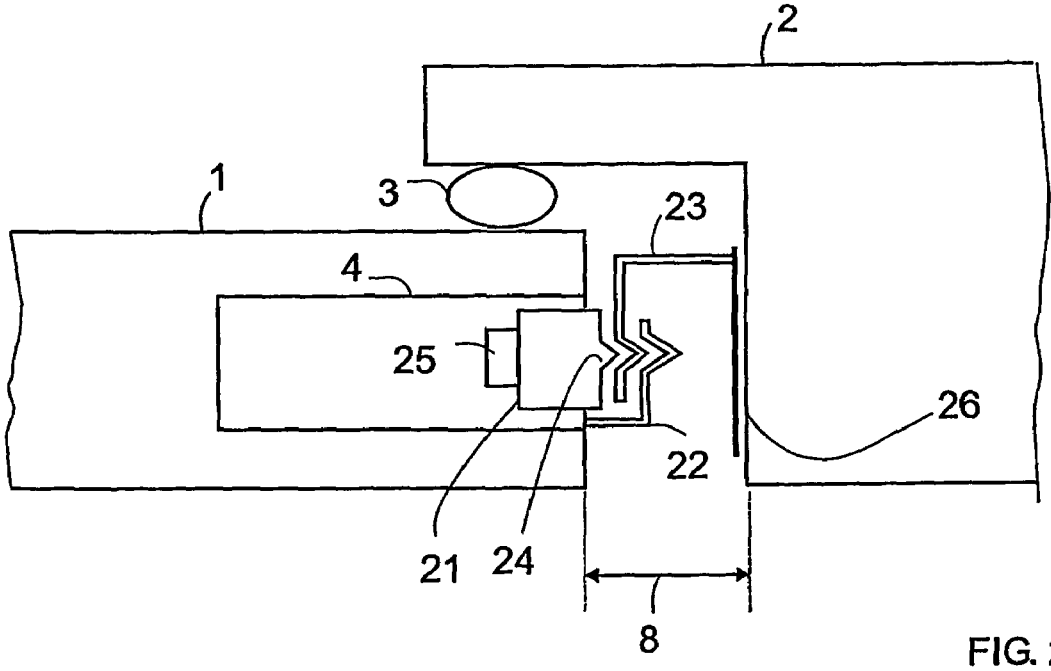
Figure 3:
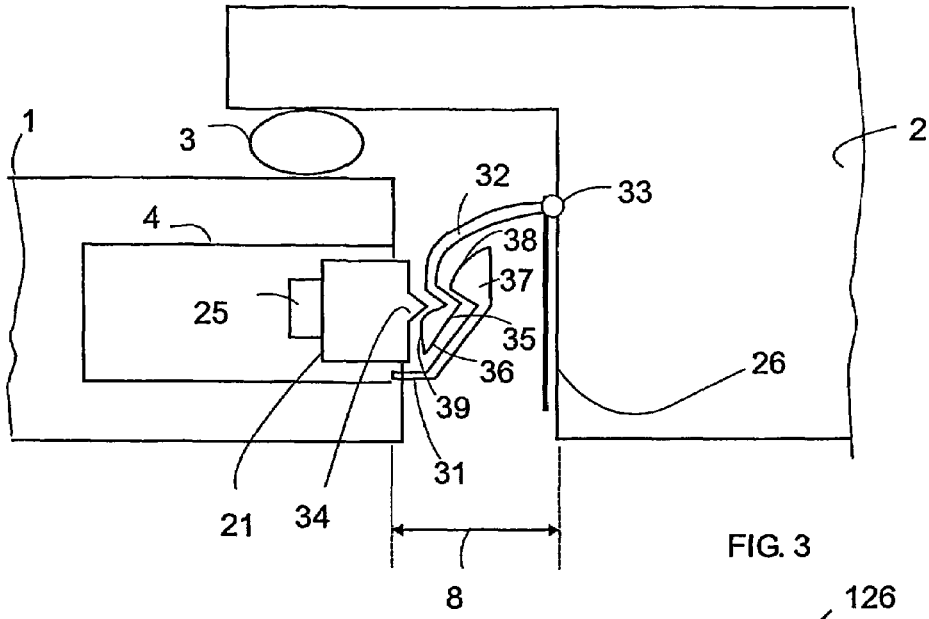
Figure 26:
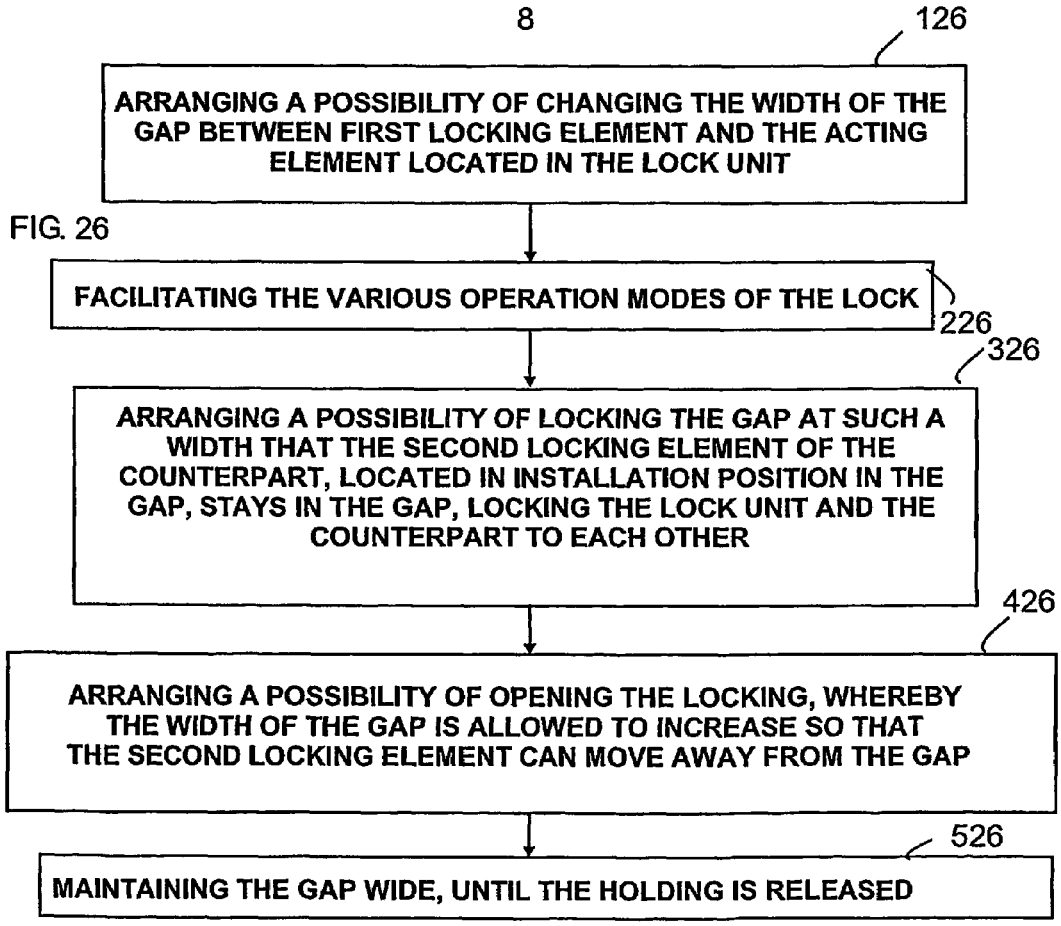
Figure 4:
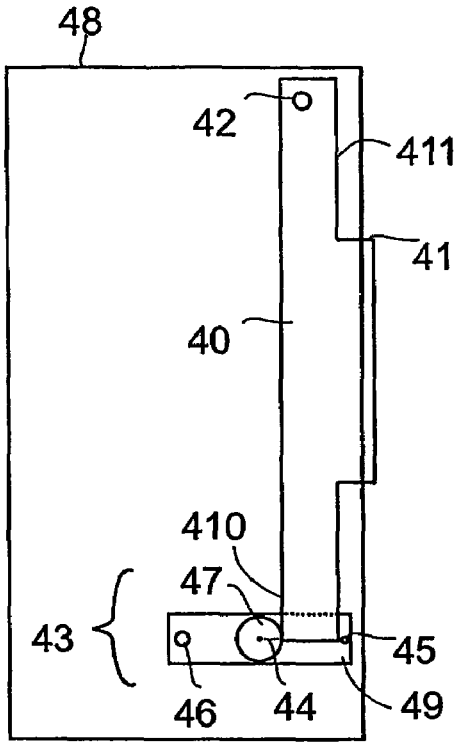
Figure 5:
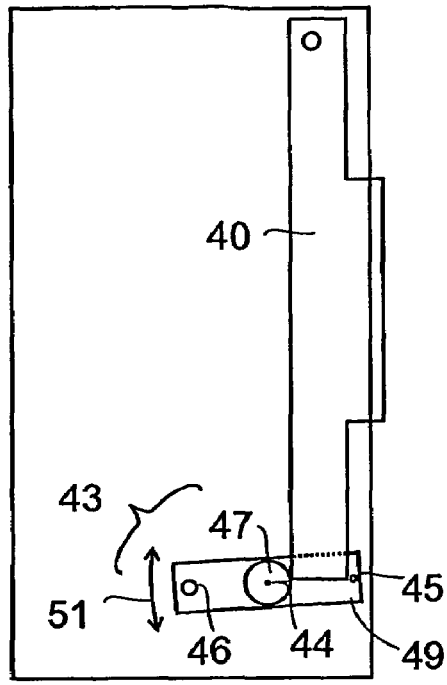
Figure 6:
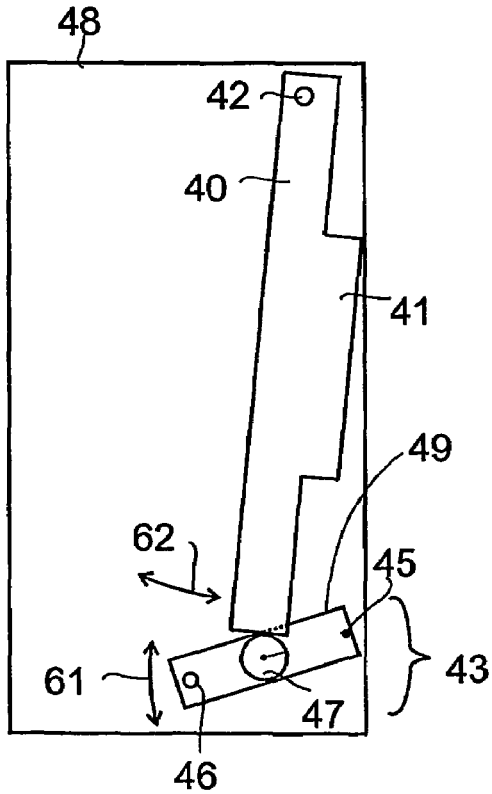
Figure 7:
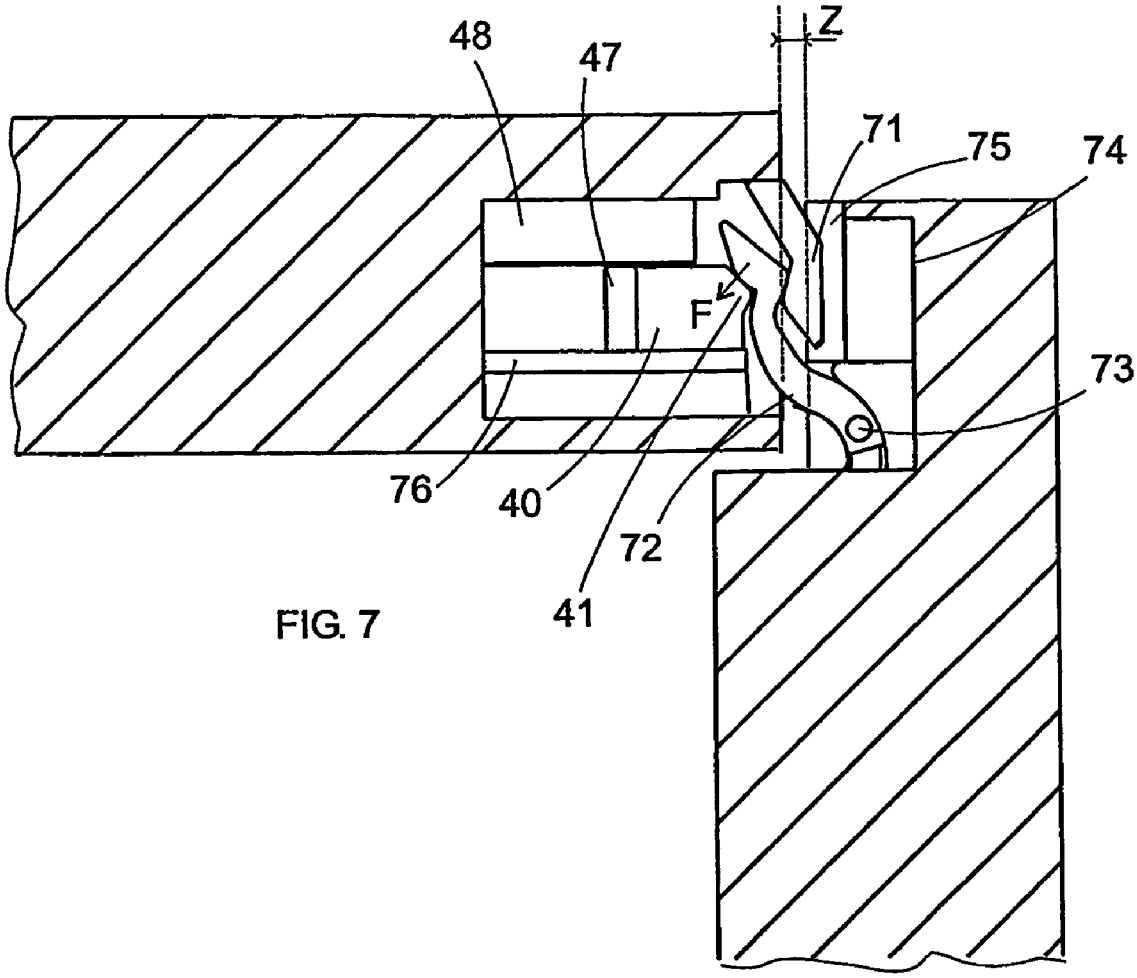
Figure 8:
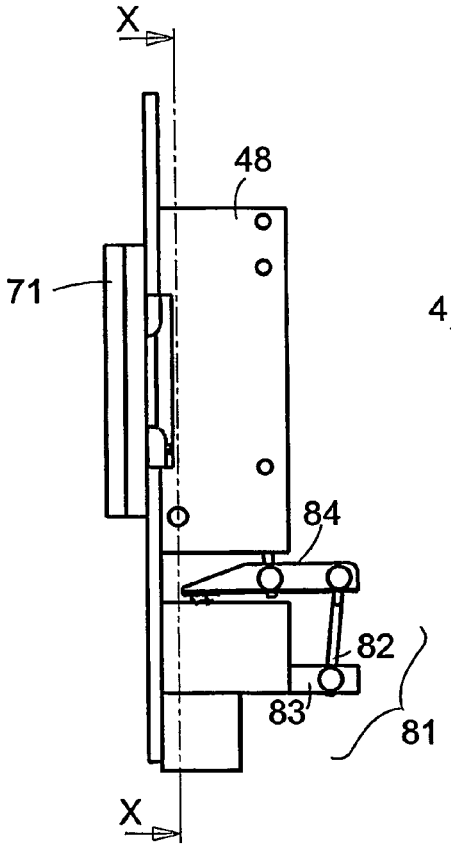
Figure 9:
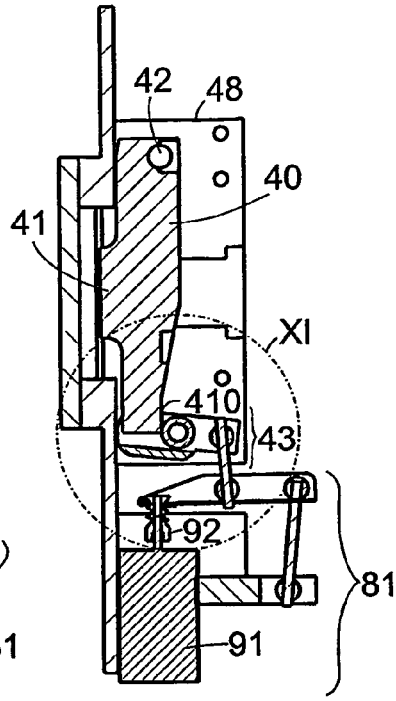
Figure 10:
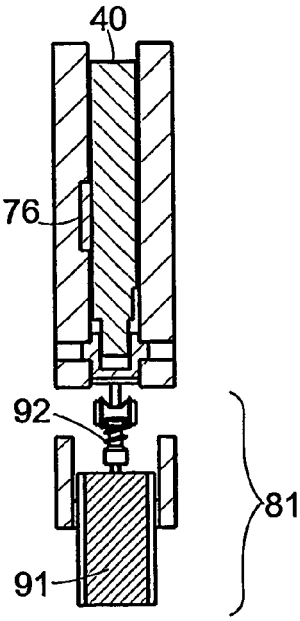
Figure 11:
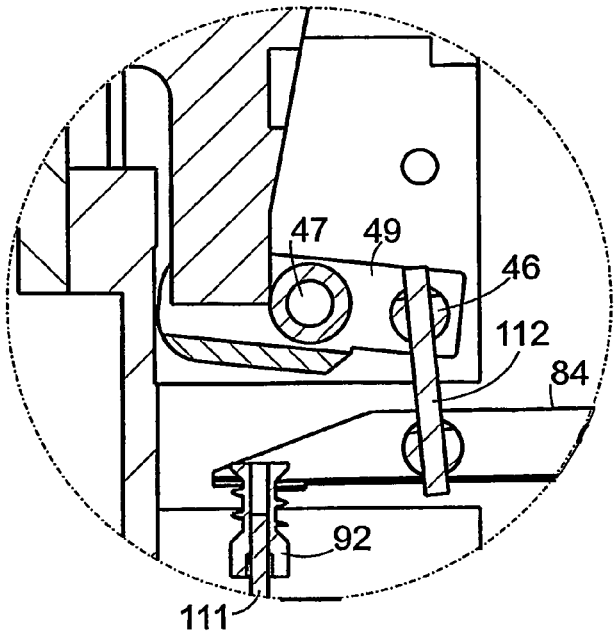
Figure 12:
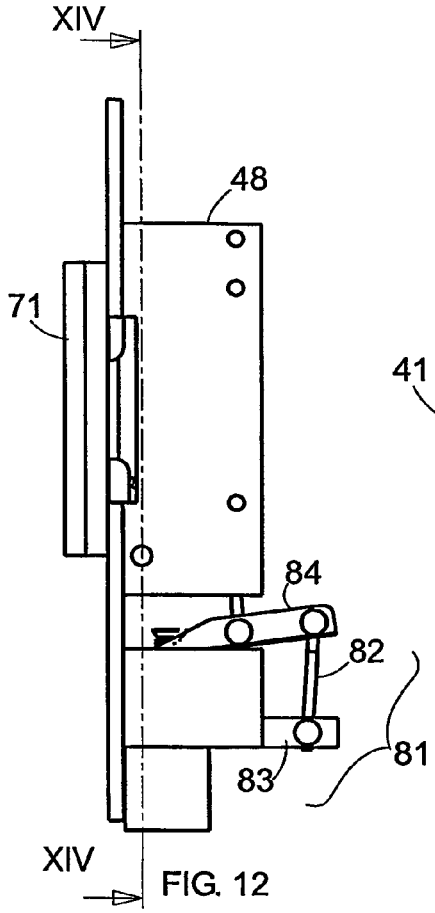
Figure 13:
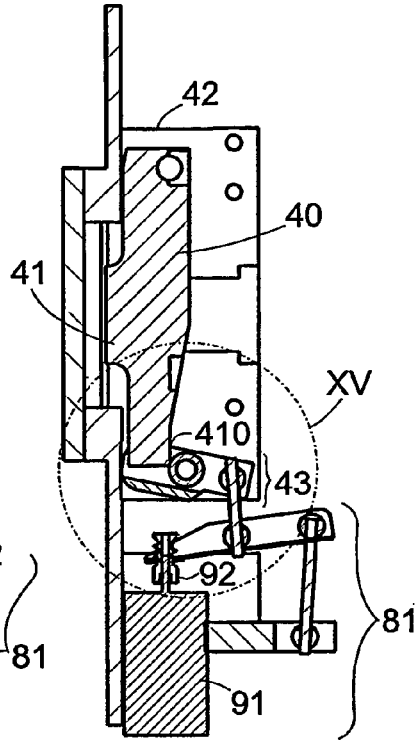
Figure 14:
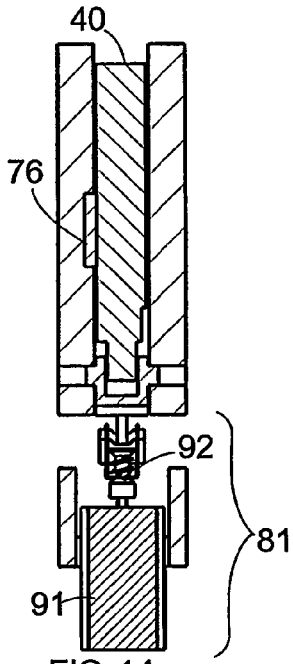
Figure 15:
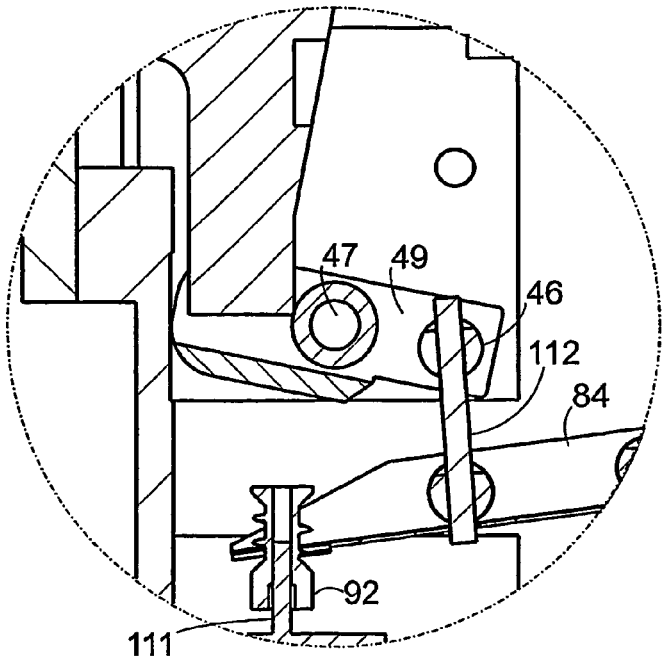
Figure 16:
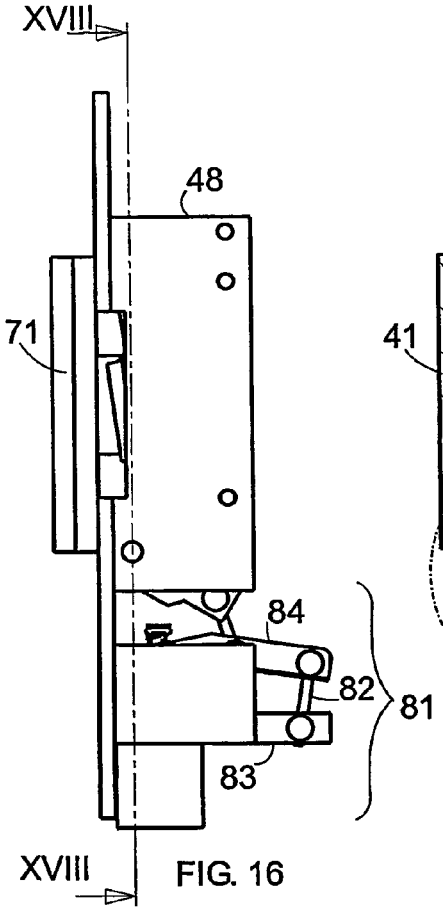
Figure 17:
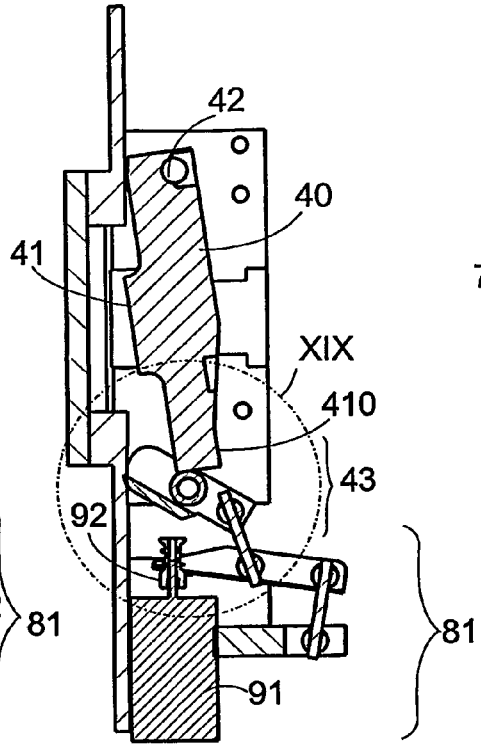
Figure 18:
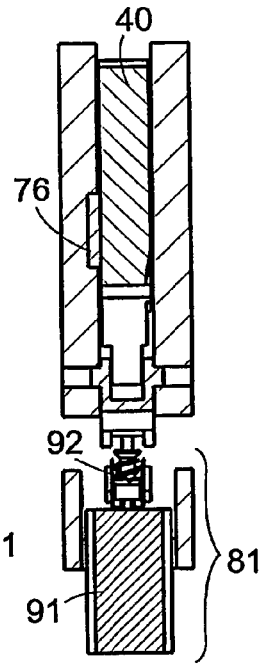
Figure 19:
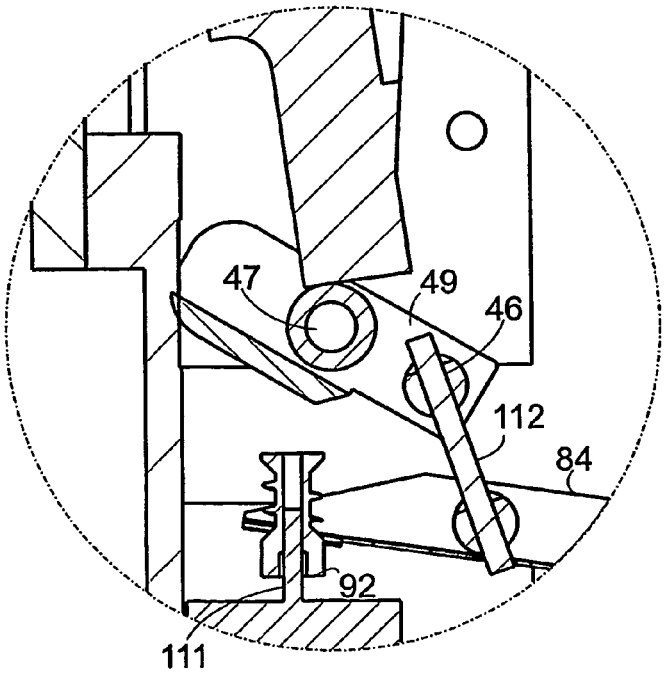
Figure 25:
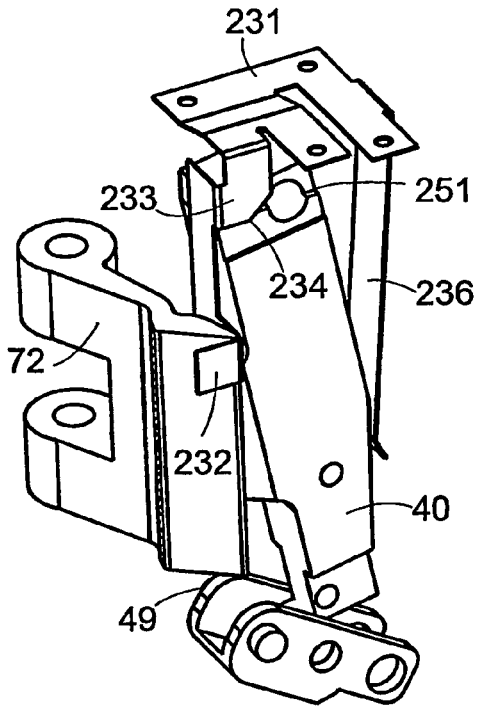
Figure 23:
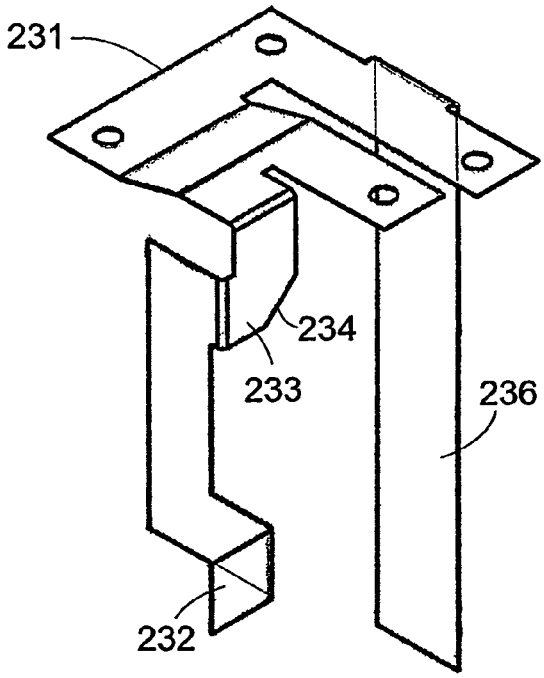
Figure 24:
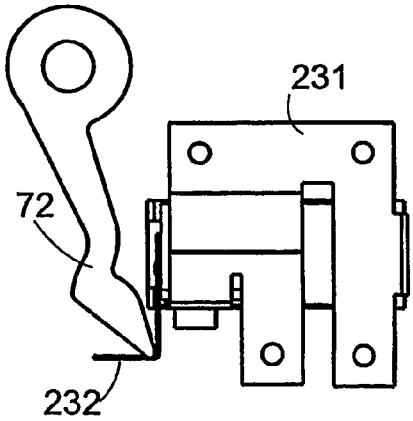

In the following, the invention is described by way of example, with reference to the appended figures, of which FIG. 1 illustrates an example of prior art, i.e. a normal latch lock, FIG. 2 illustrates a simple example of a construction according to the invention seen from above with the locking arrangement installed in the door and the door frame, FIG. 3 illustrates another simple example of a construction according to the invention, seen from above with the locking arrangement installed in the door and the frame and with the locking elements formed differently from those of FIG. 2, FIG. 4 illustrates a simple exemplary situation of an acting element according to the invention seen from the side, FIG. 5 illustrates another simple exemplary situation of an acting element according to the invention seen from the side, FIG. 6 illustrates a third simple exemplary situation of an acting element according to the invention seen from the side, FIG. 7 illustrates an example of the form of the gripping brackets and of adjusting the locking arrangement for different door clearances, FIG. 8 illustrates a first example of the drive construction of the lock unit with the safety catch on, FIG. 9 illustrates a sectional view of FIG. 8, seen from the same direction, FIG. 10 illustrates a sectional view of FIG. 8 from the indicated direction and location, FIG. 11 illustrates a partial enlarged view of a part indicated in FIG. 9, FIG. 12 illustrates a first example of the drive construction of the lock unit with the safety catch off, FIG. 13 illustrates a sectional view of FIG. 12, seen from the same direction, FIG. 14 illustrates a sectional view of FIG. 12 from the indicated direction and location, FIG. 15 illustrates a partial enlarged view of a part indicated in FIG. 13, FIG. 16 illustrates a first example of the drive construction of the lock unit with the safety catch off and the acting element in withdrawn position, FIG. 17 illustrates a sectional view of FIG. 16, seen from the same direction, FIG. 18 illustrates a sectional view of FIG. 16 from the indicated direction and location, FIG. 19 illustrates a partial enlarged view of a part indicated in FIG. 17, FIG. 20 illustrates another example of the drive construction of the lock unit with the safety catch on, FIG. 21 illustrates another example of the drive construction of the lock unit with the safety catch off, FIG. 22 illustrates another example of the drive construction of the lock unit with the safety catch off and the acting element in withdrawn position, FIG. 23 illustrates an example of the holding spring of the locking arrangement, FIG. 24 illustrates an example of how the second locking element acts on the holding spring, FIG. 25 illustrates an example of the operation of the holding means in cooperation with the locking element and the acting element, FIG. 26 is an exemplary flow chart of the method according to the invention.

Figure 27:
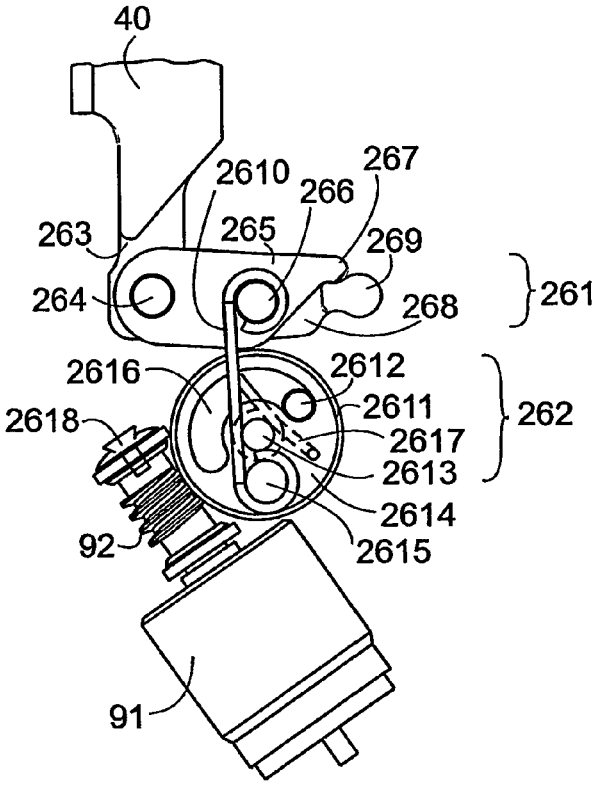
Figure 28:
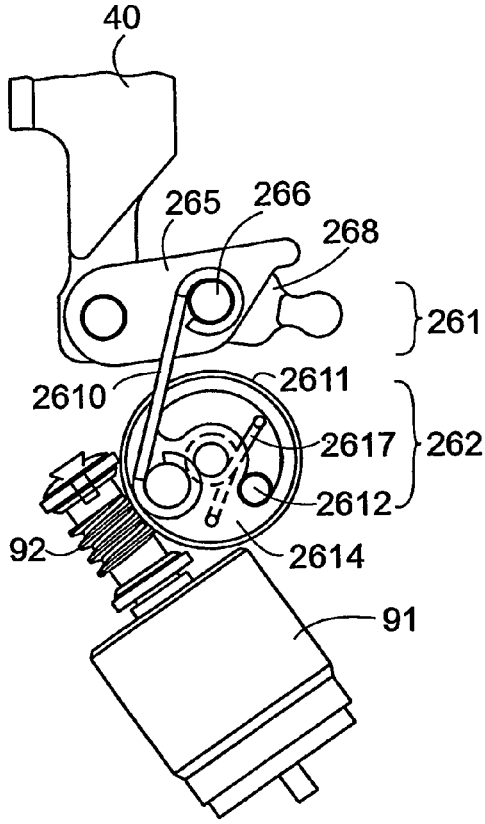
Figure 30:
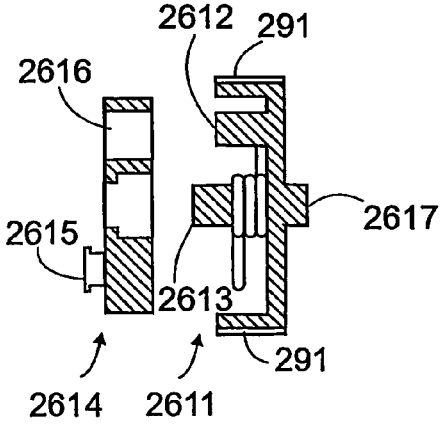
Figure 29:
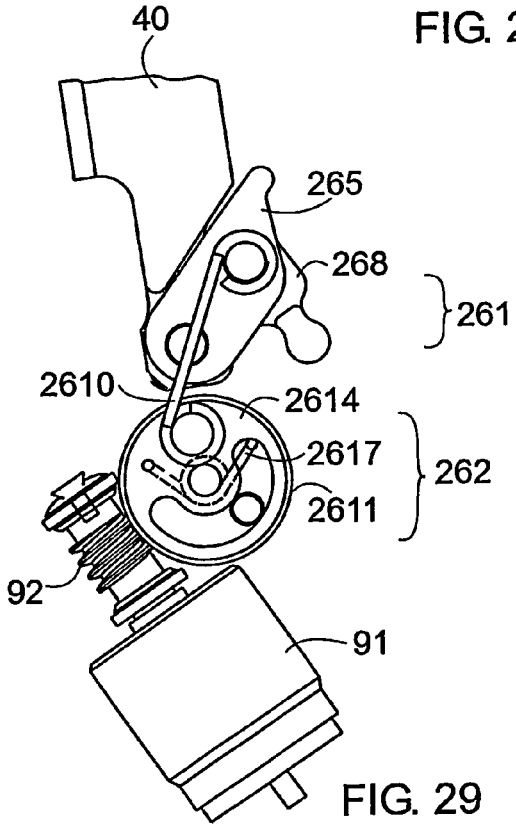

FIG. 27 illustrates a further example of a drive construction and a safety catch, where the acting element is at the front position, FIG. 28 illustrates the drive construction and the safety catch of FIG. 27 wherein the safety catch has been driven open, FIG. 29 illustrates the drive construction and the safety catch of FIG. 27 wherein the acting element is at the back position, and FIG. 30 shows a drive and a worm wheels of the drive construction of FIGS. 27-29.

DESCRIPTION OF THE INVENTION

FIG. 2 illustrates a simple example of a construction according to the invention seen from above with the locking arrangement installed in the door 1 and the door frame 2. In the example of FIG. 2 the lock unit 4 is installed in the door and the counter part 26 is installed in the door frame. The first locking element, i.e. the gripping bracket 22, is fastened to the lock unit (the body thereof) and the second locking element, i.e. gripping bracket 23, is fastened to the counter part. In the situation illustrated in the figure, with the door closed in the door opening, the gripping brackets 22, 23 are overlapping each other.

The lock unit also comprises the acting element 21, the gripping bracket 24 of which is formed following the shapes of the gripping brackets 22, 23. Thus, when the gap between the bracket 22 of the first locking element and the actuating element is at its narrowest, i.e. when the acting element is in the front position, the second locking element 23 has just enough room to be located in the opening, whereby the shape of the acting element and the brackets keep the bracket of the second locking element in the gap, if the acting element is locked.

The locking of the acting element can be achieved by means of a safety catch, pressing the rear surface of the acting element. The safety catch is used for achieving the controlled support of the acting element. The safety catch is a means for locking the acting element into a certain position, in this case the front position. Thus, the external force acting on the acting element does not move the safety catch to another position. In this position the safety catch is said to be on. In more detail, the safety catch comprises a reel part 25, pressing the acting element. If the safety catch is not on (off), i.e. the reel does not firmly press the rear surface of the acting element (410, e.g. FIG. 4) when the door is pulled open the second locking element 23 presses on the acting element, whereby the reel does not firmly support and the acting element is allowed to move towards its withdrawn position. Simultaneously, the gap between the first locking element 22 and the acting element widens and the second locking element is allowed to exit the gap. Thus, the door 1 can be opened. In other words, when the acting element is in the front position, the safety catch is on and the locking elements are overlapping, the locking is closed. When the safety catch is off while the acting element is still in the front position and the locking elements are overlapping, the locking is open, in which state a force acting on the locking elements or the counter part, separating the units, will push the second locking element from the gap, whereby the second locking element will simultaneously pull the acting element into the withdrawn position, and whereby the second free end moves past the first free end.

FIG. 3 illustrates another simple example of the construction according to the invention as seen from above, with the locking arrangement installed to the door and the frame, in which arrangement the locking elements are formed differently from those in FIG. 2. The free end 36 of the second locking element 32 is formed so that the inner edge 35 of the bracket, beginning from the free end, is slanted, and the outer edge 39 on the other side of the bracket is curved. The bracket is fastened to the counter part by means of a hinge 33 or the like, whereby the hinge will allow the bracket to move within a desired degree range. This movement can also accommodate different door clearances and the fluctuation of the clearance. The free end 37 of the first bracket 31 has also been formed, whereby it's inner edge 38 has been bevelled.

The bevelled surfaces 35, 38 make it easier for the brackets to overlap when the door is being closed. The curved surface 39, on the other hand, will ensure that there's always an effective contact surface between the first locking element and the second locking element, if there's an attempt at opening the door. When the locking is on, the acting element 21 can not move to the withdrawn position, but its gripping bracket 34 presses the second locking element 32 upon opening the door, the second locking element correspondingly being pushed against the first locking element 31. It can be seen from FIG. 3 that the form of the acting element and the two locking elements can have an effect on the operability of the locking arrangement. Additionally, it can be seen that it is preferable for the fastening of the second locking element to the counter part to be, e.g. a hinged fastening 33, whereby a certain movement of the second locking element is allowed. The second locking element could also be manufactured from a resilient material, whereby the hinged fastening or the like fastening is not necessary, as the locking element itself allows a certain movement. The material can be resilient in only a certain part of the locking element, such as the bottom of the locking element.

It is also preferably for the construction of the counter part to include a spring for keeping the second locking element in a desired position, in which the door is open.

In FIGS. 2 and 3 the gaps between the brackets and the acting element are exaggerated for reasons of clarity. In reality the gaps are considerably smaller. Thus, FIGS. 2 and 3 illustrate the principle of the invention, and they therefore are not accurate embodiments as far as shapes and scales are concerned.

FIG. 4 illustrates a simple exemplary situation of an acting element 40 according to the invention as seen from the side of the lock unit 48. The figure does not show the first lock unit, but it is only intended to illustrate the action of the acting element and the safety catch 43. In FIG. 4 the acting element 40 is in the front position, whereby the gripping bracket 41 on the side of the front surface 411 thereof is in front and the gap between it and the first locking element is at its smallest. The acting element is formed of an stem-like construction (arm), being fastened to the body of the lock unit at the position of the hinge means 42, at the first end of the arm, i.e. the upper end thereof. Thus, the arm can turn about the hinge point formed by the hinge means.

In addition to what is described above, the lock can also be installed upside down in relation to FIG. 4 (and other Figures), whereby the hinge means 42 is in the lower end of the arm in the installed position. It is, however, easier to describe the invention so that the hinge means is up, as shown in the appended figures. Thus, this text refers to an installed position, whereby the hinge of the arm is in the upper end. It is additionally possible to arrange the arm in a horizontal position, if the width of the construction is sufficient. This alternative is mainly considered when it is desired to install the lock unit in the frame structure of the door (i.e. the thickness of the wall can be used for installing the locking arrangement in the desired position).

The safety catch 43, by means of which the acting element can be locked in the front position, is preferably located in the lock unit, so that the reel 47 of the safety catch firmly presses the rear surface 410 of the arm at the lower end thereof (i.e. the other end of the arm). Thus, the rear surface is a counter surface, on which the safety catch is pressing. The pressure on the counter surface is as firm as possible when the radius of the reel of the safety catch points perpendicularly to the counter surface. When the safety catch is on, i.e. it locks the arm in the front position, the centre 44 of the reel is on the level of the rear surface of the arm or inside it. Thus, the rear edge is the edge of the counter surface (surface that the safety catch presses on when on) and the area inside the rear edge is the area of the counter surface. The safety catch also comprises an arm 49, hinged 45 by its other end to the body of the lock unit, whereby the arm can move in relation to the hinge point defined by the hinge. The other end of the hinge is hinged 46 to the drive construction, not shown in FIG. 4.

FIG. 5 illustrates another simple exemplary situation of an acting element according to the invention seen from the side. In this case the safety catch 43 is not on, i.e. the acting element 40 is not locked in the front position. The force transmitted from the drive construction via hinge 46 has moved 51 the arm of the safety catch downwards while the relation of the fastening hinge point 45 of the arm has kept the other end in place. Thus the centre 44 of the reel 47 has moved to the outer edge of the acting element, whereby the reel no more firmly presses the rear surface of the arm. In this operational state the lock is open and the acting element is allowed to move to the withdrawn position. In a practical installation situation this means that when the lock unit is installed in the door, the door is closed, but it can be pushed/pulled open.

FIG. 6 illustrates a third simple exemplary situation of an acting element according to the invention, seen from the side. In this example the door is pushed/pulled open in a practical installation situation. Thereby the force of the opening of the door acting on the gripping bracket 41 of the acting element 40 pushes the arm towards the withdrawn position while the hinge point 42 keeps the upper end of the arm in place. As the lower end of the arm moves backwards, its rear surface simultaneously pushes the reel 47, so that when the centre of the reel is outside the rear surface the reel can move and simultaneously the arm of the safety catch moves downwards. (Please note that if the lock unit is installed the other way round, the directions of the operations are reversed.) This operation of the safety catch 43 allows the acting element to move 62 (preferably about 10 degrees) to the withdrawn position shown in the Figure. The fastening hinge point 45 of the safety catch will keep the fastening end of the safety catch in place and the drive construction allows the other end of the arm to move 61 down.

In a practical installation situation, when the arm is in withdrawn situation, this means that the door is open. Thus, it is also preferable to keep the arm in the withdrawn situation until the door is closed again, whereby the arm is allowed to move back to the front position. It is preferable to simultaneously arrange the release of the safety catch to its upper position (e.g. by means of a spring belonging to the safety catch or the drive construction), whereby the door is again closed and the lock unit is in the state shown in FIG. 5. Thus, FIGS. 4-6 illustrate the principle of the invention, and they therefore are not accurate embodiments as far as shapes and scales are concerned.

FIG. 7 illustrates an example of the form of the gripping brackets and of adjusting the locking arrangement for different door clearances. FIG. 7 shows in more detail the same constructions that were schematically shown in FIGS. 4-6, as seen from above. The lock unit 48 is installed in the door and the counter part 74 is installed in the door frame. The door and the lock are closed in this example. The other locking element 72 has just enough space between the first locking element and the acting element 40. The reel 47 of the safety catch keeps the acting element in place. If it is now attempted to open the door, a perpendicular force F acts on the gripping bracket 41 of the acting element due to the form of the second locking element. This force tends to move the acting element to the withdrawn position, but the reel of the safety catch prevents it.

Part of the force F is transmitted via the friction surface 76 to the body of the lock unit. The operability of the lock can be influenced by means of the properties of the friction surface. If the friction coefficient of the friction surface is small, the acting element moves easier when opening the door, but simultaneously a larger force acts on the safety catch. The larger the force acting on the safety catch, the more energy is needed to open the lock, i.e. moving the safety catch off. This is important in for example panic situations (note the above-mentioned panic exit regulations). If, on the other hand, the friction coefficient of the friction surface is larger, a larger part of the force of opening the door is used on the friction surface, whereby less energy is needed for moving the safety catch. In practical solutions the friction coefficient is preferably about 0.3. The friction surface is on the side of the acting arm acting as a support surface as the opening force acts on the gripping bracket of the acting element, while the friction surface and the support surface are in contact with each other during the said opening force F. The opening force is essentially on the level of the gripping surface of the acting element. Structurally the friction surface can be a part of the actual structure of the lock body, acting element or a friction piece fastened to the body or the acting element.

The locking arrangement is suitable for various door clearances Z (the gap between the door and the door frame). This is especially due to the hinge 73, via which the second locking element is fastened to the counter part 74. The hinge and the construction of the counter part allow the locking element to move within a certain angle sector (preferably about 10-15 degrees), whereby the overlapping of the first and second locking element is made possible. The shapes of the locking elements make the overlapping easier as well. As can be seen in FIG. 7, with the clearance Z of this example there must be an indentation 75 in the counter part 74, into which the first locking element enters when the door is being closed. With a larger clearance the indentation might not be necessary. The door clearance is typically between 1 to 5 mm. The shape, size and even necessity of the indentation can be effected on by the shape and location of the locking elements.

It can be seen in FIGS. 7 and 3, that seen from the first free end (37, FIG. 3), after the bevelling, the inner edge of the bracket of the locking element comprises a notch. The outer edge of the second locking element comprises a convex curved surface adjacent the second free end or beginning from the second free end. The bevelled surface of both the curved surface and the inner surface of the second locking element terminate at the arm of the bracket at a point in which the arm starts to curve outwards, forming a curve before the fastening end of the bracket of the second locking element, whereby an indentation is formed between the curved surface and the curve. The gripping bracket of the acting element comprises a tab, which is located in the position of the indentation of the bracket of the second locking element when the gap is at its narrowest and the brackets are overlapping, whereby in this position the inside surface located in the position of the indentation of the second locking element additionally settles into the notch of the first locking element. The surfaces of the tab of the gripping means are essentially straight on both sides of the ridge or on the side of the tab on which the force, if any, from the second locking element is acting.

FIG. 8 illustrates a first example of the drive construction 81 of the lock unit with the safety catch on. A section line and a direction for the sectional view of FIG. 10 have been marked in FIG. 8. FIG. 9 illustrates a sectional view of FIG. 8, seen from the same direction. In FIG. 9, the part of which FIG. 11 is a partial enlarged view, is indicated with a dotted line. FIGS. 8-11 illustrate the structures of FIGS. 4-7 in more detail.

In the first example, the drive construction 81 comprises a transferring arm 112, which is hinged 46 by its one end to the arm 49 of the safety catch and by its other end to the other drive construction. The other drive construction comprises a transmission screw 92, a transmission arm 84 and a supporting arm 82, which is hinged by its one end to the body of the lock unit, in this example via support 83, and by its other end to the other end of the transmission arm 84.

In closer detail, the transmission arm 84 is supported by its other end to the screw thread of the transmission screw and hinged by its central part to the transferring arm 112, whereby the power, if any, rotating the screw will move the other end of the transmission arm in the screw thread, as a result of which the movement of the transmission arm will move the transferring arm, whereby the arm of the safety catch will also move. In this example, the transmission screw is connected to the electric motor 91 via shaft 111. The electric motor produces the force, if any, rotating the screw. The electric motor can also be connected to a control unit. Typically, the control unit controls the operation of the motor in response to external signals, which can be control signals, signals indicating a panic situation or the like. The transmission screw can alternatively or additionally be connected to a mechanical power apparatus.

Thus FIGS. 8-11 illustrate a situation in which the acting element is in front position and the lock closed, i.e. the safety catch is on. If an electric motor is used for rotating the transmission screw, the position of the safety catch can be changed. FIGS. 12-15 illustrate a situation in which the first drive construction is in the second position, in which the safety catch is off and the acting element 40 is in the front position. The safety catch has been pulled down via the transmission screw so that the centre point of the reel 47 of the safety catch is below the lower edge of the acting element. Thus, the acting element can be moved to the withdrawn position by external power.

FIGS. 16-19, on the other hand, illustrate a situation, in which the acting element has been moved to the withdrawn position by the external force while the safety catch is off. In this situation the reel of the safety catch is totally below the acting element. It is preferable for practical operation to keep the acting element in the withdrawn position until, for example, when closing a door, it is allowed to again move to the front position. A spring is used for this purpose, the spring being described later in more detail. It is to be noted that in FIGS. 8-10, 12-14 and 16-18 there is a spring around the part 82 pushing the parts 83 and 84 apart. This spring causes the drive constructions to automatically return to the desired position when the acting element moves from the withdrawn position to the front position.

FIGS. 20-22 illustrate an example of another drive construction 208. In this construction the drive construction comprises a transferring arm 201, hinged 46 by its one end to the arm 49 of the safety catch and by its other end 202 to the other drive construction. The other drive construction comprises a transmission screw 92, transmission spring 205 and a supporting arm 203, hinged 204 by its one end to the body of the lock unit and by its other end to the said transferring arm.

The transmission spring is essentially u-shaped and it is supported by its one end to the screw thread of the transmission screw 92 and by its other end to the central part of the supporting arm, in more detail to the fastening notch 206, in which the fastening end of the spring can move. Additionally, the spring (preferably a coil spring) is supported 207 at the curve to the body of the lock unit.

The force, if any, rotating the screw 92, moves the end of the spring supported in the screw thread, whereby the movement of the spring 205 moves the supporting arm 203 and the transferring arm 201 via the supporting arm fastening, whereby also the arm 49 of the safety catch moves. In FIG. 20 the safety catch is on and the acting element is in front position. In FIG. 21 the safety catch is off and the acting element is in front position, and in FIG. 22 the safety catch is off and the acting element is in withdrawn position.

FIG. 23 illustrates an example of the holding spring 231 of the locking arrangement, the purpose of which is to maintain the acting element in the withdrawn position, for example when the door is open. The holding spring can be made of, for example metal, but it can also be made of another material, such as a suitable plastic. A part of the holding spring 233, called the holding surface, keeps the acting element in the withdrawn position. In order to ease the operation of the spring there preferably is a bevelling 234 in the holding surface of the spring. When the door or the like is being closed, the free end of the second locking element 72 contacts the part 232 of the spring release bracket, the part being called the release surface, whereby the locking element pushes the release surface. Because the spring is made of a resilient material, the push by the second locking element deflects the spring, whereby the holding surface moves, allowing the acting element to move into the front position. FIG. 24 illustrates, seen from above, how the second locking element has an effect on the holding spring. The holding spring also comprises a pushing part 236, which pushes the acting element towards the front position, thus securing the movement of the acting element to the front.

FIG. 25 illustrates an example of the operation of the holding spring 231 together with the second locking element 72 and the acting element 40. It can be seen in the Figure that the acting element includes a bevel 251, with which the holding surface 233 of the spring abuts when the acting element is in the withdrawn position. In this example the acting element is still in the withdrawn position, and the second locking element has just pushed the release surface 232 of the spring, whereby the spring is deflected and the holding surface 233 moves away from the bevel 251. The acting element can now move to the front position. The pushing part 236 of the spring ensures the movement.

FIG. 26 is an exemplary flow chart of the method according to the invention. Because the locking arrangement according to the invention includes operations that are non-existent in prior art arrangements, the invention also relates to a method for the operations of the locking arrangement according to the invention. The method offers 126 a possibility to change the gap between the first locking element and the acting element in the lock unit and facilitate the various operation modes of the lock 226. Changing the width of the gap thus means changing the position of the acting element, and making the operation modes possible means that the position of the acting element and the state of the safety catch described above (on, off, pushed down) together form the operation mode of the lock. These operations 126, 226 are basic operations that can be completed by other operations.

In order to lock the lock, a position in which the gap is locked 326 to such a width that in the above-mentioned installation position the second locking element of the counter part stays in the gap. locking the lock unit and the counter part together, is needed.

Additionally, in order to open the lock, a possibility of opening 426 the locking is offered, whereby the width of the gap is allowed to increase so that the second locking element is allowed to move away from the gap. The method can further include an auxiliary operation, whereby the gap is kept 526 wide while it is wide, until the holding is released, whereby the gap is allowed to decrease in width.

FIGS. 27 to 29 describes yet another drive construction 262 and an embodiment of a safety catch 261. As can be seen in these figures, the safety catch 261 comprises two arms 265, 268 which have been hinged 266 together at the other ends of the arms. The first arm 265 has also been hinged 264 to the lower end 263 of the acting element 40. The lower end 263 is preferably chamfered. The end of the first arm 265, which comprises the hinge 266 for the hinging with the second arm 268, also comprises a bracket 267 for forming a toggle joint with the other end 269 of the second arm. The other end 269 of the second arm comprises a locking surface for the bracket 267 of the first arm, and also forms a support joint against the lockbody (not showed in the figures). The support joint has been secured (not showed in the figures), for example, by a screw that allows turning of the end 269 of the second arm.

The drive construction 262 of the FIGS. 27-29 has been connected with the safety catch 261 through a transferring arm 2610. The drive construction also comprises a drive wheel 2614 and a worm wheel 2611. The end of the transferring arm 2610 has been connected to the hinge point 266 of the arms of the safety catch. The other end of the transferring arm has been connected to the drive wheel 2614, more particularly to a connection pin 2615 of the drive wheel.

The drive wheel comprises a central hole and a drive hole 2616. The worm wheel 2611 comprises a central pin 2613, a drive pin 2612 and a gear cutting 291 on the edge of the wheel. The drive wheel 2614 is attached to the worm wheel 2611 so that the drive pin 2612 penetrates to the drive hole 2616 and the central pin 2613 to the central hole. The edges of the worm wheel cover the edges to the drive wheel. FIG. 30 shows the drive and worm wheels. A spring 2617 is situated between the wheels. The spring is put around the central pin 2613 of the worm wheel and the first end of the spring is attached to the worm wheel and the second end to the drive wheel as showed in FIGS. 27-29.

The gear cutting 291 of the worm wheel matches with the screw thread of the transmission screw 92, i.e. with the worm screw, that is fixed onto the axis of the electric motor 91 through a coupling gear 2618. The coupling gear 2618 between the axis of the electric motor and the worm screw is for preventing the screw getting blocked and for saving electric energy. The coupling gear slides in desired situations in which cases the drive from the electric motor to the worm wheel is cut.

In FIG. 27, the acting element 40 is at the front position. The safety catch 261 is locked as the toggle joint is at the safety angle. The worm wheel has been driven counter-clockwise to the lock position by the electric motor, when the drive pin 2612 is at the desired position. When driven to this position, the spring 2617 has been strained at the same time. This strain has discharged when the door is closed rotating the drive wheel, moving the transferring arm and locking the toggle joint. A little pre-strain remains in the spring 2617. In other words, FIG. 27 shows a door closed—lock locked situation.

FIG. 28 shows the situation wherein the safety catch 261 has been driven open by the electric motor 91. The worm screw has rotated the worm wheel 2611 clock-wise via the connection between the screw threads and the gear cutting 291. The drive pin 2612 of the worm wheel in the drive hole 2616 has forced the drive wheel to turn as well. The turn of the drive wheel has moved the transferring arm 2610 that moved the toggle joint open. The spring 2617 has moved but not forced to be in any extra strain. In other words, FIG. 28 shows door closed—lock open situation.

If a door is moved open when the lock is open, the acting element 40 moves to the back position as described in FIG. 29. The arms 265, 268 of the safety catch 261 turn in respect of the hinge points of the arms allowing the acting element to move back. The transferring arm 2610 moves as well turning the drive wheel clock-wise at the same time. At this time, the worm wheel does not rotate. The drive pin stays still in the long drive hole 2616 that moves along the drive wheel. At this time, however, the spring 2617 is forced to be in extra strain. In other words, FIG. 29 shows door open—lock open situation.

The acting element 40 stays still in the back position with the help of the holding spring 231, but when the door is closed, the extra strain of the spring discharges rotating the drive wheel counter-clockwise. The rotation of the drive wheel moves the safety catch 261 either the lock position of FIG. 27 or the open position of FIG. 28. The safety catch 261 moves to the lock position if the worm wheel is driven counter-clockwise to the lock position as showed in FIG. 29 when the door is open or when closing the door. In this, way, the spring gets more strain for moving the safety catch to the lock position.

As has been described above, the width of the locked gap is such that the second locking element has just enough space there, whereby the second locking element stays in the gap due to the form of the gap, which is due to the design of the locking elements and the acting element. There are many design alternatives. For example, the above-mentioned surface of the gripping bracket does not have to be straight (straight on both sides of the bracket or on other side), but it can follow the form of the other one, i.e. it can be, for example, concave. The locking elements and the acting element can thus be, for example, cylindrically formed (concave on one side and convex on the other side).

Due to the shape, geometry, mutual operation and the friction surface of the parts of a lock according to the invention, an opening force of, for example, about 500 Newton acts on the reel of the safety catch with a smaller force (preferably with a force of only about 80-90 N). If the safety catch is now moved 1 mm, a considerably smaller force, preferably even only 10 N, is needed to overcome the frictional force and the rolling resistance. The drive construction further decreases the necessary power output from the electric motor and because the movement of the safety catch is short, the necessary amount of energy is less than 100 mJ, preferably only of the order of 10 mJ. Thus, due to the short movement and small force, no expensive and complex transmission is needed for the electric motor, but instead, a simple screw pinion and lever will turn the rotation of the motor into the necessary movement of the safety catch. The necessary torque can easily be produced with, for example, a small DC motor. Because the necessary motor revolutions are few and no separate reduction gearing is needed due to the low torque, the operation time of the motor per one opening/closing is very short.

Thus, the system according to the invention uses much less energy for opening and closing the lock than prior art locks. The locking element itself, such as the latch, is not moved, but only the safety catch is moved a short distance (a few millimeters). Further, the locking arrangement according to the invention utilises the opening and closing force of the door. The opening force pushes the acting element of the lock in the withdrawn position and the closing force releases the acting element back to the front position. The elements according to the invention lock the door and the door frame to each other so that if there is an attempt to open the door by wedging something into the door gap at the locking, the wedging in fact pushes the locking more closely together.

Additionally, in a locking arrangement according to the invention there is no need to use separate sensors for indicating whether, for example, the door is open, lock locked and lock open, but one sensor can indicate all this. When the sensor is observing the position of the safety catch, a sufficient amount of information about the state of the locking is produced.

The locking arrangement according to the invention can be produced by means of a number of solutions. The locking arrangement can, for example, comprise more than one lock per door or the like. The lock unit can be located in the door frame and the counter part can be located in the door or vice versa. The locks can be controlled, in addition to via wires permanently connected to the locks, via air as well, if the lock has a radio interface (such as a small radio transmitter/receiver). Thus, the locking of large housings can also be centrally controlled. The voltage supply and/or control can be introduced into the lock via contact surfaces in the door and the door frame when the door is locked.

The above-mentioned gripping brackets can be fastened to the lock body in a number of ways. For example, in addition to the gripping bracket being fastened by its one end, it can also be fastened above and below it. Additionally, the gripping bracket, especially the gripping bracket fastened to the lock unit, can in a way be sunk into the lock body. In different solutions it is essential that there be a gap between the first locking element and the acting element, into which the second locking element can enter and into which it can be locked (it can be said to be wedged there).

Further to the fact that the gripping surface, i.e. the gripping bracket, of the acting element has been described as a protruding tab, it can also be a groove. In this embodiment the shape of the groove follows the shape of the first locking element. The gripping bracket should in this context thus be understood as either a tab or a groove of the acting element. The gripping bracket can also be a structurally separate part. In this case the gripping bracket can be separately manufactured and fastened to the arm later.

The safety catch does not either necessarily include a reel. The arm can also include a part of another shape, the part giving sufficient support to the acting element when the safety catch is on and allowing the acting element to move to the withdrawn position when the safety catch is off. In other words, the construction of the safety catch can differ from that described in this disclosure.

The power needed by the operation of the lock does not have to come from the electric motor, but it can be produced in other ways as well, such as with a solenoid or the like, or mechanically (a traditional mechanical key).

On the basis of what's described above, it will be obvious that the invention can be carried out in ways other than those described here. Thus, the invention is not limited to the embodiments described here, but it can be carried out by means of a number of various solutions within the scope of the invention.

The invention claimed is:

1. A locking arrangement for locking a first part and a second part together, one of said first and second parts being turnable relative to the other of said first and second parts about a swing axis and being a door, a hatch or the like and the other of said first and second parts being a door frame or the like, the locking arrangement comprising:

a lock unit installable in the first part and including a lock body and a first locking element having a first free end region which, when installed, extends generally transversely of said swing axis, a counterpart unit installable in the second part and including a second locking element having a second free end region which, when installed, extends generally transversely of said swing axis, an acting arm that includes a gripping formation and is pivotally mounted in the lock unit for movement relative to the lock body about a pivot axis, whereby the acting arm can turn in relation to the lock unit so that the acting arm moves transversely in relation to the first free end region between a projecting position in which the gripping formation is relatively closer to said first free end region and a withdrawn position in which the gripping formation is relatively farther from said first free end region, and a safety catch that is operable selectively either to lock the acting arm against movement from the projecting position to the withdrawn position or to permit the acting arm to move from the projecting position to the withdrawn position, the safety catch comprising first and second arms each having a first end and a second end, the first and second arms being hinged together at the respective first ends forming a toggle joint between the arms, the second end of the first arm being hinged to the acting arm at a location spaced from said pivot axis, and the second end of the second arm being hinged to the lock body, and wherein said units cooperate in such a manner that when said units are installed and said one part is in a closed position relative to said other part, the free end regions of said locking elements overlap each other, and when the acting arm is in the projecting position and the safety catch locks the acting arm against movement from the projecting position to the withdrawn position, the second free end region is captive between the gripping formation and the first free end region for achieving locking action by the locking arrangement, whereas when the acting arm is in the projecting position and the safety catch permits the acting arm to move from the projecting position to the withdrawn position, the locking action is released.

2. An arrangement according to claim 1, including a drive mechanism coupled to at least one of the first and second arms for applying force to move the hinge between the first and second arms from a first location towards a second location, and wherein movement of the hinge between the first and second arms from the first location to the second location causes the acting arm to move from its projecting position to its withdrawn position.

3. An arrangement according to claim 2, wherein the drive mechanism comprises a transferring arm coupled at a first end to the hinge between the first and second arms, and a means for moving a second end of the transferring arm along a path such as to cause the transferring arm to displace the hinge from the first location towards the second location.

4. An arrangement according to claim 3, wherein the means for moving the second end of the transferring arm comprises a worm and a worm gear in meshing engagement with the worm, and rotation of the worm causes the worm gear to rotate and rotation of the worm gear in a first direction causes the second end of the transferring arm to move along said path.

5. An arrangement according to claim 4, comprising a drive wheel coupled to the transferring arm, and wherein the worm gear is coupled to the drive wheel for selectively turning the drive wheel in a first direction for displacing the hinge between the first and second arms from the first location towards the second location.

6. An arrangement according to claim 2, wherein the drive mechanism comprises a worm gear and a drive wheel mounted for rotation about a common axis, and a coupling means connecting the drive wheel and the worm gear for transmission of drive between the wheels.

7. An arrangement according to claim 6, wherein movement of the hinge between the first and second arms from the first location to an intermediate location between the first and second location places the safety catch in a state in which the acting arm can move to its withdrawn position, and said coupling means allows movement of the drive wheel relative to the worm gear when the hinge moves from the intermediate location to the second location.

8. An arrangement according to claim 6, comprising a worm in working engagement with the worm gear and an electric motor coupled drivingly to the worm.

9. An arrangement according to claim 1, wherein the lock unit comprises a lock body and the acting arm has a side surface that engages with a support surface of the lock body when said units are installed and an opening force acts on said one part for supporting the acting arm relative to the lock body when the acting arm moves from the projecting position to the withdrawn position.

10. An arrangement according to claim 9, wherein the support surface of the lock body and the gripping formation of the acting arm are at substantially equal distances from the axis of pivotal movement of the acting arm.

11. An arrangement according to claim 1, wherein the counterpart unit includes a body member and the second locking element is attached to the body member by a hinge that allows the second locking element to turn relative to the body member.

12. An arrangement according to claim 1, wherein the counterpart unit includes a body member formed with an indentation for receiving the first locking element when the units are installed and said one part is in the closed position relative to said other part.

13. An arrangement according to claim 1, wherein the locking elements and the acting arm are configured to prevent the lock unit and the counterpart unit from moving away from the position in which the free end regions of the locking elements overlap each other when said units are installed and said one part is in the closed position.

14. An arrangement according to claim 1, comprising a sensor for detecting the position of the safely catch.

15. An arrangement according to claim 1, wherein the counterpart unit comprises a body member to which the second locking element is attached, and a spring for keeping the second locking element in a desired position relative to the body member of the counterpart unit.

16. A locking arrangement for locking a first part and a second part together, one of said first and second parts being turnable relative to the other of said first and second parts about a swing axis and being a door, a hatch or the like and the other of said first and second parts being a door frame or the like, the locking arrangement comprising:

a lock unit installable in the first part and including a body and a first locking element having a first free end region which, when installed, extends generally transversely of said swing axis, a counterpart unit installable in the second part and including a second locking element having a second free end region which, when installed, extends generally transversely of said swing axis, an acting arm that includes a gripping formation and is pivotally mounted in the lock unit, whereby the acting arm can turn in relation to the lock unit so that the acting arm moves transversely in relation to the first free end region between a projecting position in which the gripping formation is relatively closer to said first free end region and a withdrawn position in which the gripping formation is relatively farther from said first free end region, and a safety catch that is operable selectively either to lock the acting arm against movement from the projecting position to the withdrawn position or to permit the acting arm to move from the projecting position to the withdrawn position, said safety catch comprising a drive mechanism, an arm having first and second ends, the arm being hingedly attached at its first end to the body of the lock unit and being attached at its second end to the drive mechanism, whereby the arm of the safety catch is turnable relative to the body of the lock unit by the drive mechanism, and a reel member that is attached to the arm of the safety catch and is movable relative to the acting arm between a locking position in which the reel member engages a rear surface of the acting arm and prevents movement of the acting arm from the projecting position to the withdrawn position and a releasing position in which the reel member permits movement of the acting arm from the projecting position to the withdrawn position, and wherein said units cooperate in such a manner that when said units are installed and said one part is in a closed position relative to said other part, the free end regions of said locking elements overlap each other, and when the acting arm is in the projecting position and the reel member is in the locking position, the second free end region is captive between the gripping formation and the first free end region for achieving locking action by the locking arrangement, whereas when the acting arm is in the projecting position and the reel member is in the releasing position, the locking action is released.

17. An arrangement according to claim 16, wherein the acting arm has a forward surface and an opposite rear surface, the gripping formation is provided at the forward surface of the acting arm, and when the reel member is in the locking position, the reel member engages the rear surface of the acting arm.

18. An arrangement according to claim 17, wherein the drive mechanism comprises a transferring arm hingedly attached at one end to the arm of the safety catch and at an opposite end to a displacement mechanism for displacing said opposite end of the transferring area.

19. An arrangement according to claim 18, wherein the displacement mechanism comprises a supporting arm hingedly attached at one end to said opposite end of the transferring arm and at an opposite end to the body of the lock unit, a transmission screw having a screw thread, and a substantially U-shaped transmission spring having first and second opposite ends and a curved portion therebetween, and the transmission spring is supported at one end by the screw thread of the transmission screw, at an opposite end by a medial part of the supporting arm, and at its curved portion by the body of the lock unit, whereby force rotating the screw is transmitted to the transferring arm via the supporting arm.

20. An arrangement according to claim 18, wherein the displacement mechanism comprises a transmission arm having first and second opposite ends and hingedly attached at a medial region to said opposite end of the transfer arm, a supporting arm hingedly attached at one end to the transmission arm at a location spaced from the connection to the supporting arm and at an opposite end to the body of the lock unit, and a transmission screw engaging the transmission arm at said first end thereof, whereby force rotating the screw is transmitted to the transferring arm via the transmission arm.

21. An arrangement according to claim 18, wherein the displacement mechanism includes a transmission screw having a screw thread, a force transmission mechanism coupling the screw thread to said opposite end of the transferring arm, and an electric motor for rotating the transmission screw.

22. An arrangement according to claim 21, comprising a control unit connected to the electric motor.

23. An arrangement according to claim 22, wherein the control unit controls the electric motor in response to an electric signal.

24. An arrangement according to claim 19, wherein the transmission screw is connected to a mechanical power apparatus for transmitting power to the screw.

25. An arrangement according to claim 16, wherein the lock unit includes a lock body, the acting arm is pivotally mounted for movement relative to the lock body about a pivot axis, the safety catch comprises first and second arms each having a first end and a second end, the first and second arms are hinged together at the respective first ends forming a toggle joint between the arms, the second end of the first arm is hinged to the acting arm at a location spaced from said pivot axis, and the second end of the second arm is hinged to the lock body.

26. An arrangement according to claim 25, including a drive mechanism coupled to at least one of the first and second arms for applying force to move the hinge between the first and second arms from a first location towards a second location, and wherein movement of the hinge between the first and second arms from the first location to the second location causes the acting arm to move from its projecting position to its withdrawn position.

27. An arrangement according to claim 26, wherein the drive mechanism comprises a transferring arm coupled at a first end to the hinge between the first and second arms and a means for moving a second end of the transferring arm along a path such as to cause the transferring arm to displace the hinge from the first location towards the second location.

28. An arrangement according to claim 27, wherein the means for moving the second end of the transferring arm comprises a worm and a worm gear in meshing engagement with the worm, and rotation of the worm causes the worm gear to rotate and rotation of the worm gear in a first direction causes the second end of the transferring arm to move along said path.

29. An arrangement according to claim 28, comprising a drive wheel coupled to the transferring arm, and wherein the worm gear is coupled to the drive wheel for selectively turning the drive wheel in a first direction for displacing the hinge between the first and second arms from the first location towards the second location.

30. An arrangement according to claim 26, wherein the drive mechanism comprises a worm gear and a drive wheel mounted for rotation about a common axis, and a coupling means connecting the drive wheel and the worm gear for transmission of drive between the wheels.

31. An arrangement according to claim 30, wherein movement of the hinge between the first and second arms from the first location to an intermediate location between the first and second location places the safety catch in a state in which the acting arm can move to its withdrawn position, and said coupling means allows movement of the drive wheel relative to the worm gear when the hinge moves from the intermediate location to the second location.

32. An arrangement according to claim 30, comprising a worm in working engagement with the worm gear and an electric motor coupled drivingly to the worm.

33. An arrangement according to claim 16, wherein the lock unit comprises a lock body and the acting arm has a side surface that engages with a support surface of the lock body when said units are installed and an opening force acts on said one part for supporting the acting arm relative to the lock body when the acting arm moves from the projecting position to the withdrawn position.

34. An arrangement according to claim 33, wherein the support surface of the lock body and the gripping formation of the acting arm are at substantially equal distances from the axis of pivotal movement of the acting arm.

35. An arrangement according to claim 16, wherein the counterpart unit includes a body member and the second locking element is attached to the body member by a hinge that allows the second locking element to turn relative to the body member.

36. An arrangement according to claim 16, wherein the counterpart unit includes a body member formed with an indentation for receiving the first locking element when the units are installed and said one part is in the closed position relative to said other part.

37. An arrangement according to claim 16, wherein the locking elements and the acting arm are configured to prevent the lock unit and the counterpart unit from moving away from the position in which the free end regions of the locking elements overlap each other when said units are installed and said one part is in the closed position.

38. An arrangement according to claim 16, comprising a sensor for detecting the position of the safely catch.

39. An arrangement according to claim 16, wherein the counterpart unit comprises a body member to which the second locking element is attached, and a spring for keeping the second locking element in a desired position relative to the body member of the counterpart unit.

40. An arrangement according to claim 16, wherein the first free end region has a beveled inner edge and the second free end region has a beveled inner edge that engages the beveled inner edge of the first free end region when the locking arrangement is installed and said other part moves towards a closed position relative to said one part, for facilitating the free end regions of said locking elements overlapping each other.

41. An arrangement according to claim 40, wherein the first free end region has a notch at an inner edge, towards the gripping formation of the acting arm, the second free end region has a projection at its inner edge and a notch at its outer edge, and the gripping formation includes a projection, whereby when the free end regions overlap and the acting arm is in the projecting position, the projection of the second free end region is received in the notch of the first free end region and the projection of the gripping formation is received in the notch of the second free end region.

42. An arrangement according to claim 41, wherein the second free end region has a curved surface at its outer side and the second locking element comprises a curved portion having a proximal end at which the second locking element is attached to the body of the counterpart unit and the indentation in the second free end region is provided between said curved portion and the curved surface of the second free end region.

43. An arrangement according to claim 41, wherein the projection of the gripping formation has at least one substantially flat surface for engaging the second free end region.

44. A locking arrangement for locking a first part and a second part together, one of said first and second parts being turnable relative to the other of said first and second parts about a swing axis and being a door, a hatch or the like and the other of said first and second parts being a door frame or the like, the locking arrangement comprising:

a lock unit installable in the first part and including a first locking element having a first free end region which, when installed, extends generally transversely of said swing axis, a counterpart unit installable in the second part and including a second locking element having a second free end region which, when installed, extends generally transversely of said swing axis, an acting arm that includes a gripping formation and is pivotally mounted in the lock unit, whereby the acting arm can turn in relation to the lock unit so that the acting arm moves transversely in relation to the first free end region between a projecting position in which the gripping formation is relatively closer to said first free end region and a withdrawn position in which the gripping formation is relatively farther from said first free end region, and when the acting arm is in the projecting position the gripping formation is spaced from the first free end region to receive the second free end region between the gripping formation and the first free end region, a holding spring for urging the acting arm from the projecting position towards the withdrawn position, and a safety catch that is operable selectively either to lock the acting arm against movement from the projecting position to the withdrawn position or to permit the acting arm to move from the projecting position to the withdrawn position, and wherein said units cooperate in such a manner that when said units are installed and said one part is in a closed position relative to said other part, the free end regions of said locking elements overlap each other, and when the acting arm is in the projecting position and the safety catch locks the acting arm against movement from the projecting position to the withdrawn position, the second free end region is captive between the gripping formation and the first free end region for achieving locking action by the locking arrangement, whereas when the acting arm is in the projecting position and the safety catch permits the acting arm to move from the projecting position to the withdrawn position, the locking action is released and a force that acts on the lock unit or the counterpart unit and tends to separate the units will pull the second locking element from between the gripping formation and the first free end region and the second locking element will simultaneously push the acting element into the withdrawn position, the holding spring has a holding portion for engaging the acting arm to retain the acting arm in the withdrawn position, and the acting arm has a groove for receiving the holding portion of the holding spring when the arm moves to the withdrawn position, whereby the acting arm remains in the withdrawn position, the holding spring comprises a releasing portion by which force may be applied to the holding spring to move the holding portion away from the groove to permit the acting arm to move to the projecting position, and when the arrangement is installed and the second free end region moves to the overlapping position, the second free end region engages the releasing portion of the holding spring and applies force moving the holding portion away from the groove in the acting arm.

* * * * *